US008508519B2

(12) United States Patent
Lee et al.

(10) Patent No.: US 8,508,519 B2
(45) Date of Patent: Aug. 13, 2013

(54) ACTIVE LEVEL SHIFT (ALS) DRIVER CIRCUIT, LIQUID CRYSTAL DISPLAY DEVICE COMPRISING THE ALS DRIVER CIRCUIT AND METHOD OF DRIVING THE LIQUID CRYSTAL DISPLAY DEVICE

(75) Inventors: Seung-Kyu Lee, Yongin (KR); Dong-Hoon Lee, Yongin (KR); Chul-Ho Kim, Yongin (KR)

(73) Assignee: Samsung Display Co., Ltd., Giheung-Gu, Yongin, Gyeonggi-Do (KR)

( * ) Notice: Subject to any disclaimer, the term of this patent is extended or adjusted under 35 U.S.C. 154(b) by 304 days.

(21) Appl. No.: 12/984,002

(22) Filed: Jan. 4, 2011

(65) Prior Publication Data

US 2011/0234551 A1 Sep. 29, 2011

(30) Foreign Application Priority Data

Mar. 29, 2010 (KR) ..... 10-2010-0028083

(51) Int. Cl.
*G09G 5/00* (2006.01)

(52) U.S. Cl.
USPC ..... 345/208; 345/87; 345/94

(58) Field of Classification Search
USPC ..... 345/47–111, 204–214, 690–699
See application file for complete search history.

(56) References Cited

U.S. PATENT DOCUMENTS 6,559,824 B1 * 5/2003 Kubota et al. ..... 345/100
6,836,269 B2 12/2004 Maeda et al.
7,508,370 B2 * 3/2009 Sekiguchi et al. ..... 345/99
7,688,394 B2 * 3/2010 Yasui et al. ..... 349/48
2006/0145986 A1 * 7/2006 Oh et al. ..... 345/92
2006/0284811 A1 * 12/2006 Huang ..... 345/92
2007/0046567 A1 * 3/2007 Ha ..... 345/38
2007/0057887 A1 * 3/2007 Itakura et al. ..... 345/90
2007/0097056 A1 * 5/2007 Tseng ..... 345/96
2007/0262976 A1 * 11/2007 Matsuda et al. ..... 345/208
2007/0285693 A1 12/2007 Kim et al.
2008/0129720 A1 * 6/2008 Lee et al. ..... 345/208
2008/0180355 A1 * 7/2008 Lee et al. ..... 345/55
2008/0180419 A1 * 7/2008 Tung et al. ..... 345/204
2008/0198120 A1 * 8/2008 Senda et al. ..... 345/92
2008/0231641 A1 * 9/2008 Miyashita ..... 345/619
2009/0015533 A1 * 1/2009 Fujita et al. ..... 345/92
2009/0085853 A1 * 4/2009 Um et al. ..... 345/92
2009/0184912 A1 * 7/2009 Eun et al. ..... 345/94
2009/0251392 A1 * 10/2009 Kim et al. ..... 345/76

(Continued)

FOREIGN PATENT DOCUMENTS

KR 1020040061448 7/2004
KR 10-2006-0007971 A 1/2006

(Continued)

OTHER PUBLICATIONS

Korean Notice of Allowance issued on Feb. 24, 2012 in connection with Korean Patent Application Serial No. 10-2010-0028083 and Request for Entry of the Accompanying Office Action attached herewith.

*Primary Examiner* — Dmitriy Bolotin
(74) *Attorney, Agent, or Firm* — Robert E. Bushnell, Esq.

(57) ABSTRACT

An active level shift (ALS) driver circuit, a liquid crystal display device including the ALS driver circuit, and a method of driving the liquid crystal display device. A liquid crystal display device having a slim external black matrix may be provided by fabricating the ALS driver circuit using inverters and a transmission gate.

17 Claims, 5 Drawing Sheets

(56) References Cited

U.S. PATENT DOCUMENTS

| | | | | |
|---|---|---|---|---|
| 2009/0267929 | A1* | 10/2009 | Jeoung et al. | 345/211 |
| 2010/0053138 | A1* | 3/2010 | Im et al. | 345/211 |
| 2010/0321365 | A1* | 12/2010 | Fanchiang et al. | 345/211 |
| 2011/0227894 | A1* | 9/2011 | Choi et al. | 345/211 |
| 2012/0242711 | A1* | 9/2012 | Choi et al. | 345/690 |

FOREIGN PATENT DOCUMENTS

| | | | |
|---|---|---|---|
| KR | 1020070002220 | | 1/2007 |
| KR | 1020070117759 | | 12/2007 |
| KR | 1020080076316 | | 8/2008 |
| KR | 10-2008-0113616 | A | 12/2008 |
| KR | 10-2009-0080427 | A | 7/2009 |

* cited by examiner

ACTIVE LEVEL SHIFT (ALS) DRIVER CIRCUIT, LIQUID CRYSTAL DISPLAY DEVICE COMPRISING THE ALS DRIVER CIRCUIT AND METHOD OF DRIVING THE LIQUID CRYSTAL DISPLAY DEVICE

CLAIM OF PRIORITY

This application makes reference to, incorporates the same herein, and claims all benefits accruing under 35 U.S.C §119 from an application earlier filed in the Korean Industrial Property Office on 29 Mar. 2010, and there duly assigned Serial No. 10-2010-0028083 by that Office.

BACKGROUND OF THE INVENTION

1. Field of the Invention

The present invention relates to a liquid crystal display (LCD) device, and more particularly, to an active level shift (ALS) driver circuit capable of reducing the width of an external black matrix, a LCD device including the ALS driver circuit, and a method of driving the LCD device.

2. Description of the Related Art

A liquid crystal display (LCD) device is light weight, thin, and driven with low power consumption, and thus is widely used as a display device, such as a laptop or a portable television (TV).

The LCD device includes a gate driver and an active level shift (ALS) driver, and displays an image by adjusting light transmittance according to a signal applied to a plurality of control switches aligned in a matrix from the gate driver and the ALS driver.

The ALS driver uses two direct current (DC) voltages to generate an ALS voltage. The ALS driver maintains a previous ALS voltage while writing the LCD device by a gate-ON voltage and changes the ALS voltage by a gate-OFF voltage. Since the ALS driver includes a latch circuit to maintain the previous ALS voltage, a clock generator is required, thereby increasing the size of the ALS driver circuit.

As an external black matrix BM of the LCD device has been slimmed, the internal circuit of the ALS driver needs to be simplified.

SUMMARY OF THE INVENTION

The present invention provides a simplified active level shift (ALS) driver circuit by which an external black matrix is slimmed, a liquid crystal display device including the ALS driver circuit, and a method of driving the liquid crystal display device.

According to an aspect of the present invention, there is provided an active level shift (ALS) driver circuit including: a first inverter that receives and inverts a gate signal and outputs the inverted signal; a second inverter that receives and inverts the output signal from the first inverter and outputs the inverted signal; a third inverter that receives and inverts the output signal from the second inverter and outputs the inverted signal; a transmission gate that receives the output signals from the second inverter and third inverter as control signals and is turned on when the output signal from the third inverter is at a low level to output a first power signal; and a transistor that receives the output signal from the third inverter and is turned on when the output signal from the third inverter is at a high level to output a second power signal.

The first power signal may be an alternating current (AC) voltage signal, and the second power signal may be a direct current (DC) voltage signal. The second power signal may be a DC common voltage.

The first power signal may swing with respect to the second power signal by a predetermined level.

The output signal from the third inverter may be applied to a PMOS control terminal of the transmission gate, and the output signal from the second inverter may be applied to a NMOS control terminal of the transmission gate.

The first inverter and the second inverter may delay the gate signal.

The ALS driver may output the first power signal when the gate signal is at an active level and output the second power signal when the gate signal is at an inactive level.

According to another aspect of the present invention, there is provided a liquid crystal display device including: a liquid crystal panel including a plurality of pixel regions formed at intersections between a plurality of data lines and a plurality of gate lines; a data driver that is connected to the plurality of data lines and applies a data signal to the data lines; a gate driver that is connected to the plurality of gate lines and sequentially applies a gate signal to the gate lines; and an active level shift (ALS) driver that is connected to a plurality of ALS lines disposed to be parallel to the gate lines and outputs one of an alternating current (AC) voltage signal and a direct current (DC) voltage signal, according to a voltage level of the gate signal.

The pixel region may include: a thin film transistor formed at the intersection between the gate line and the data line; a liquid crystal capacitor that charges a data voltage when the thin film transistor is turned on by the active level gate signal; and a storage capacitor that receives the AC voltage signal or the DC voltage signal from the ALS line.

The liquid crystal display device may further include a driving voltage generator that generates the AC voltage signal and the DC voltage signal and supplies the AC voltage signal and the DC voltage signal to the ALS driver.

According to another aspect of the present invention, there is provided a method of driving a liquid crystal display device including a plurality of pixel regions formed at intersections between a plurality of data lines and a plurality of gate lines, the method including: applying a gate signal to the gate lines; turning on a switching device of the pixel region with the gate signal; applying the data signal to the pixel region from the data line via the switching device; and outputting one of an alternating current (AC) voltage signal and a direct current (DC) voltage signal to ALS lines disposed to be parallel to the gate lines, according to a voltage level of the gate signal.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
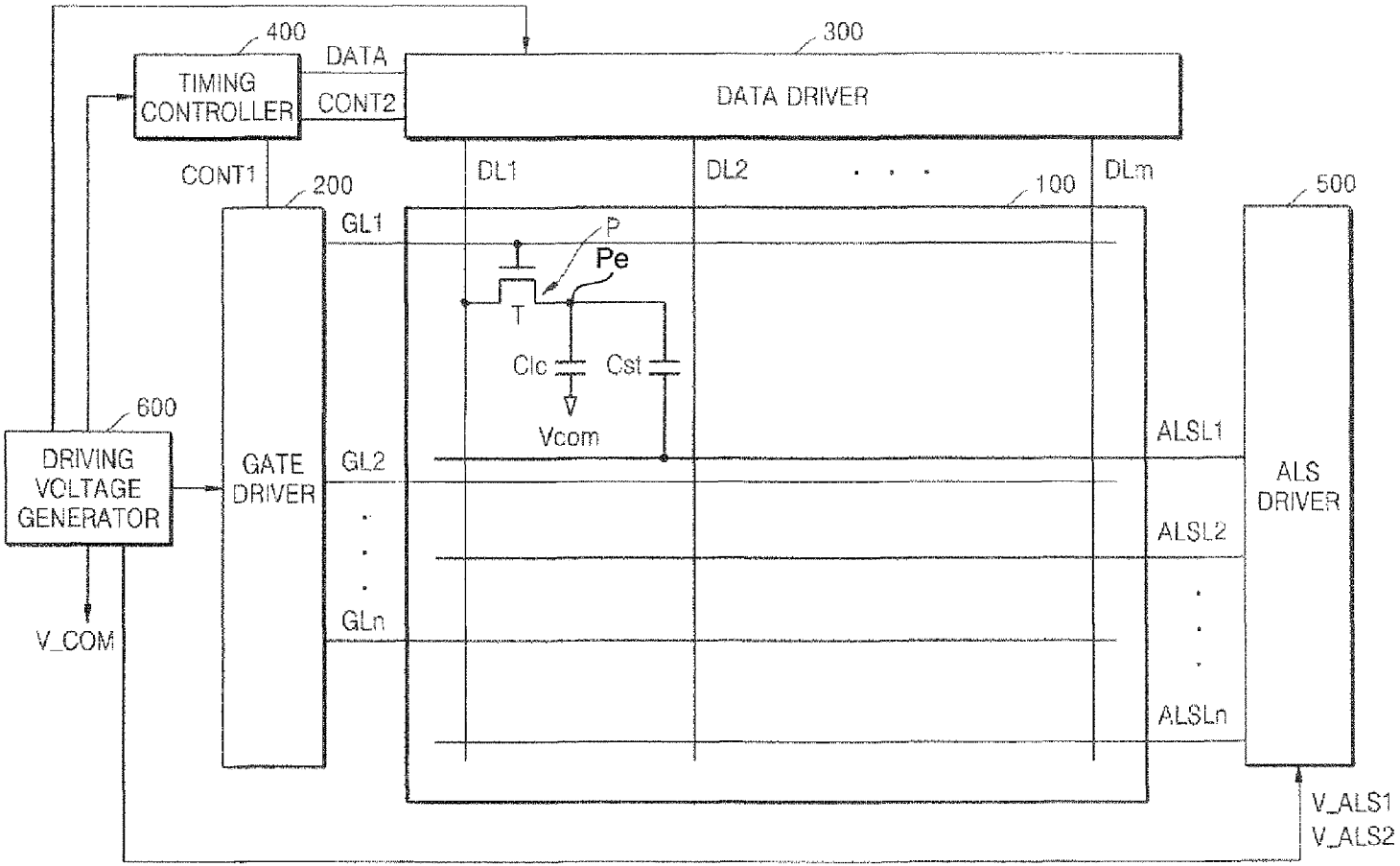
FIG. 1 is a circuit diagram schematically illustrating a liquid crystal display (LCD) device according to an embodiment of the present invention.

Hereinafter, the present invention will now be described more fully with reference to the accompanying drawings, in which exemplary embodiments of the invention is shown. In the drawings, like reference numerals denote like elements, and the size and thicknesses of layers and regions are exaggerated for clarity. Also, while describing the present invention, detailed descriptions about related well-known functions or configurations that may diminish the clarity of the points of the present invention are omitted.

FIG. 1 is a circuit diagram schematically illustrating a liquid crystal display (LCD) device according to an embodiment of the present invention.

Referring to FIG. 1, the LCD device includes a liquid crystal panel 100, a gate driver 200, a data driver 300, a timing controller 400, an active level shift (ALS) driver 500, and a driving voltage generator 600.

The gate driver 200 may generate a gate signal having a combination of an active level gate-ON voltage and an inactive level gate-OFF voltage and sequentially supply the gate signal to the liquid crystal panel 100 via a plurality of gate lines GL1 to GLn. A thin film transistor T is turned on or off according to the gate ON/OFF voltage. The gate lines GL1 to GLn extend across a first data line DL1 to an mth data line DLm, and the gate voltage is applied to from a pixel region electrically connected to the first data line DL1 to a pixel region electrically connected to the mth data line DLm.

The data driver 300 sequentially supplies a data signal to the liquid crystal panel 100 via a plurality of data lines DL1 to DLm. The data driver 300 converts an input image data DATA that is input from the timing controller 400 and has a gray scale into a data signal in the form of voltage or current.

The timing controller 400 receives an input image data and an input control signal that controls the display of the input image data from an external graphic controller (not shown). The input control signal includes a horizontal synchronization signal Hsyn, a vertical synchronization signal Vsync, and a main clock MCLK. The timing controller 400 delivers the input image data DATA to the data driver 300 and generates a gate control signal CONT1 and a data control signal CONT2 and transmits the generated gate control signal CONT1 and the data control signal CONT2 respectively to the gate driver 200 and the data driver 300.

The ALS driver 500 sequentially applies an ALS voltage to the liquid crystal panel 100 via a plurality of ALS lines ALSL1 to ALSLn. Each of the ALS lines ALSL1 to ALSLn is disposed between every two adjacent gate lines GL1 to GLn to be spaced apart from the gate lines GL1 to GLn by a predetermined distance in parallel. According to another embodiment, the ALS lines ALSL1 to ALSLn may be disposed in parallel to the data lines DL1 to DLm or at the outside of pixel electrodes.

The ALS driver 500 outputs one of a first power signal and a second power signal to the ALS lines ALSL1 to ALSLn according to the voltage level of the gate signal. The first power signal is an alternating current (AC) voltage signal, and the second power signal is a direct current (DC) voltage signal. The ALS driver 500 outputs the first power signal when the gate signal is at an active level and outputs the second power signal when the gate signal is at an inactive level. The second power signal may be a DC common voltage applied to a common electrode.

The driving voltage generator 600 generates a driving voltage for each component. The driving voltage generator 600 generates and supplies a DC common voltage Vcom, which is a reference voltage, while driving a liquid crystal cell. Referring to FIG. 1, the driving voltage generator 600 generates the common voltage Vcom. However, the LCD device may further include a common voltage generator that generates a common voltage.

In addition, the driving voltage generator 600 generates the first power signal and the second power signal and outputs them to the ALS driver 500. The first power signal may be an AC first ALS voltage V_ALS1, and the second power signal may be a DC second ALS voltage V_ALS2.

The liquid crystal panel 100 may be formed by disposing a liquid crystal layer between two substrates, namely, a first and second substrate. The data lines DL1 to DLm, the gate lines GL1 to GLn, the ALS lines ALSL1 to ALSLn, each thin film transistor T, each pixel electrode Pe, each liquid crystal capacitor Clc, and each storage capacitors Cst are formed on a first substrate (not shown) of the liquid crystal panel 100. Additionally, though not shown, black matrixes, color filters, and common electrodes are formed on a second substrate of the liquid crystal panel 100.

The gate lines GL1 to GLn are disposed in separate rows, and the data lines DL1 to DLm are disposed in separate columns. The ALS lines ALSL1 to ALSLn are disposed to be parallel to the gate lines GL1 to GLn. The gate lines GL1 to GLn and the data lines DL1 to DLm are disposed in a matrix forming pixel regions P at intersections therebetween. A pixel region P, that is a minimal unit for forming an image, is switched ON by a gate voltage and has transmittance determined by a data signal.

Each pixel region P includes a thin film transistor T, a pixel electrode Pe, a liquid crystal capacitor Clc, and a storage capacitor Cst.

In the thin film transistor T, a gate electrode is connected to the gate line, a first electrode is connected to the data line, and a second electrode is connected to the pixel electrode Pe. The thin film transistor T is turned on when the gate-ON voltage is applied to the gate electrode and transmits the data voltage applied from the data line to a pixel electrode Pe.

The liquid crystal capacitor Clc is connected to the thin film transistor T such that a first electrode of the liquid crystal capacitor Clc is connected to the pixel electrode Pe and a second electrode of the liquid crystal capacitor Clc is connected to a common electrode to form an electric field between the pixel electrode Pe and the common electrode. The liquid crystal capacitor Clc adjusts an amount of light or blocks light, which is transmitted when alignments of liquid crystal molecules in a liquid crystal layer are changed due to an electric field when the data voltage is applied to the pixel electrode Pe and a common voltage Vcom is applied from the common voltage line to the common electrode.

The storage capacitor Cst includes a first electrode connected to the pixel electrode Pe and a second electrode connected to an ALS line. The storage capacitor Cst maintains the data voltage charged in the liquid crystal capacitor Clc until a subsequent data voltage is charged.

An AC first ALS voltage V_ALS1 is applied to the second electrode of the storage capacitor Cst via the connected ALS line when an active level gate-ON voltage is applied to the connected gate line, and a DC second ALS voltage V_ALS2 is applied to the second electrode of the storage capacitor Cst via the connected ALS line when an inactive level gate-OFF voltage is applied to the connected gate line. The DC second ALS voltage V_ALS2 may be a DC common voltage V_COM that is applied to the common electrode.

Figure 2:
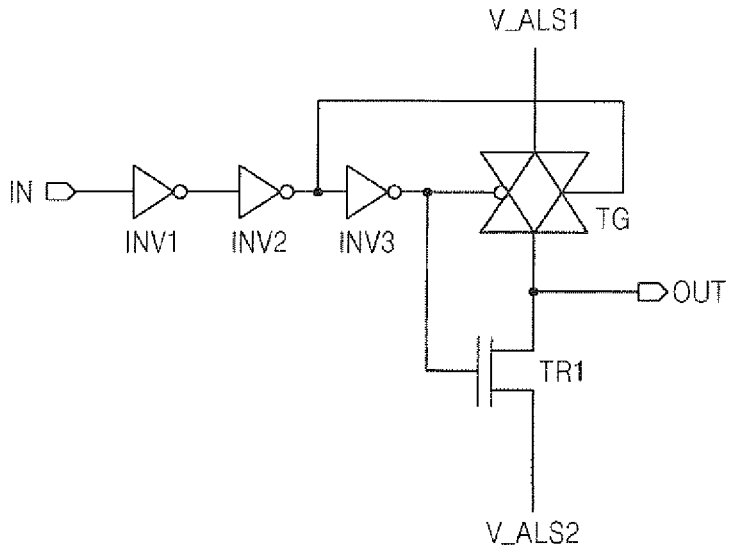
FIG. 2 is a circuit diagram of an active level shift (ALS) driver of FIG. 1.
Figure 3:
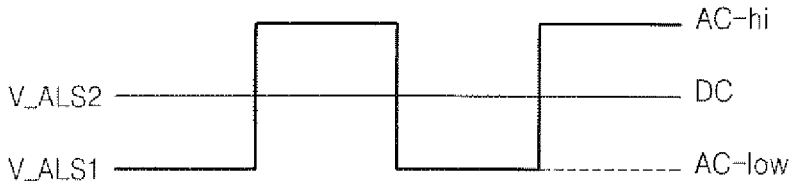
FIG. 3 is a waveform illustrating a driving voltage of the ALS driver.

FIG. 2 is a circuit diagram of an ALS driver of FIG. 1, and FIG. 3 is a waveform illustrating a driving voltage of the ALS driver.

Referring to FIG. 2, the ALS driver 500 according to the current embodiment includes a first inverter INV1, a second inverter INV2, and a third inverter INV3, which invert an input signal and output the inverted signal, a transmission gate TG and a transistor TR1, which are disposed between a first power source and a second power source.

The first inverter INV1 includes an input node electrically connected to an input terminal IN and an output node electrically connected to an input node of the second inverter INV2. The first inverter INV1 inverts the gate signal input via the input node and outputs the inverted signal via the output node. The second inverter INV2 includes an input node electrically connected to the first inverter INV1 and an output node electrically connected to an input node of the third inverter INV3. The second inverter INV2 inverts the output signal received from the first inverter INV1 via the input node and outputs the inverted signal that has the same level as the initial gate signal via the output node.

The first inverter INV1 and the second inverter INV2 delay a signal.

The third inverter INV3 includes an input node electrically connected to the second inverter INV2 and an output node electrically connected to the transmission gate TG. The third inverter INV3 inverts the output signal received from the second inverter INV2 via the input node and outputs the inverted signal that has the same level as the signal output from the first inverter INV1 via the output node.

A control terminal of the transmission gate TG is electrically connected to the output node of the second inverter INV2 and the output node of the third inverter INV3. The transmission gate TG functions as a switch changing outputs between the AC first ALS voltage V_ALS1 and the DC second ALS voltage V_ALS2 between the first power source and the second power source.

Figure 4:
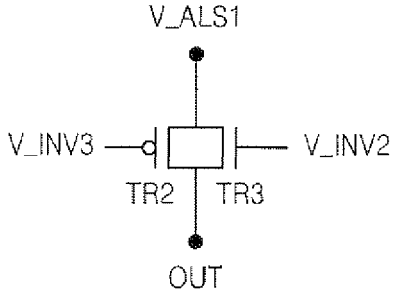
FIG. 4 is a circuit diagram of a transmission gate constituting the ALS driver.

FIG. 4 is a circuit diagram of a transmission gate constituting the ALS driver.

As shown in FIG. 4, in the transmission gate TG, first terminals and second terminals of a PMOS transistor TR2 and an NMOS transistor TR3 are simultaneously connected to the output terminal OUT, and the first power source having a first ALS voltage V_ALS1, while the output signal V_INV2 from the second inverter INV2 and the output signal V_INV3 from the third inverter INV3 (which are complementary to each other) are supplied to the control (gate) terminals of TR3 and TR2, respectively. The transmission gate TG is turned on when the output signal V_INV3 from the third inverter INV3 is at the low level and turned off when the output signal V_INV3 from the third inverter INV3 is at the high level.

Referring to FIG. 3, the first power source provides an AC voltage, and the second power source provides a DC voltage. The second power source provides a second ALS voltage V_ALS2, which is a DC voltage and the first power source provides a first ALS voltage V_ALS1 that is an AC voltage and swings between the high-level AC_hi and low-level AC-low with respect to the second ALS voltage V_ALS2. The second power source may provide a DC common voltage V_COM applied to a common electrode.

When turned on, the transmission gate TG receives the first ALS voltage V_ALS1 and outputs the first ALS voltage V_ALS1 to the output terminal OUT.

The transistor TR1 (FIG. 2) includes a control (gate) terminal electrically connected to the output node of the third inverter INV3, a first terminal (source or drain) electrically connected to the second power source, and a second terminal (drain or source) electrically connected to the transmission gate TG. The transistor TR1 may be a NMOS transistor. The transistor TR1 is turned on when a high-level signal is applied to the control terminal and turned off when a low-level signal is applied to the control terminal. When turned on, the transistor TR1 receives the second ALS voltage V_ALS2 and outputs the second ALS voltage V_ALS2 to the output terminal OUT.

Figure 5A:
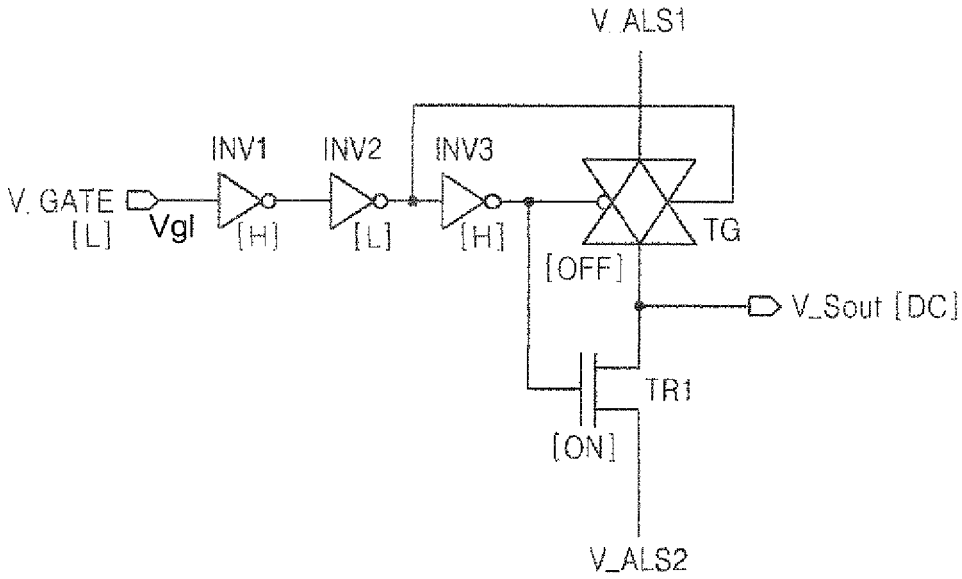
FIGS. 5A and 5B are circuit diagrams illustrating a driving process of the ALS driver of FIG. 2, according to embodiments of the present invention.
Figure 5B:
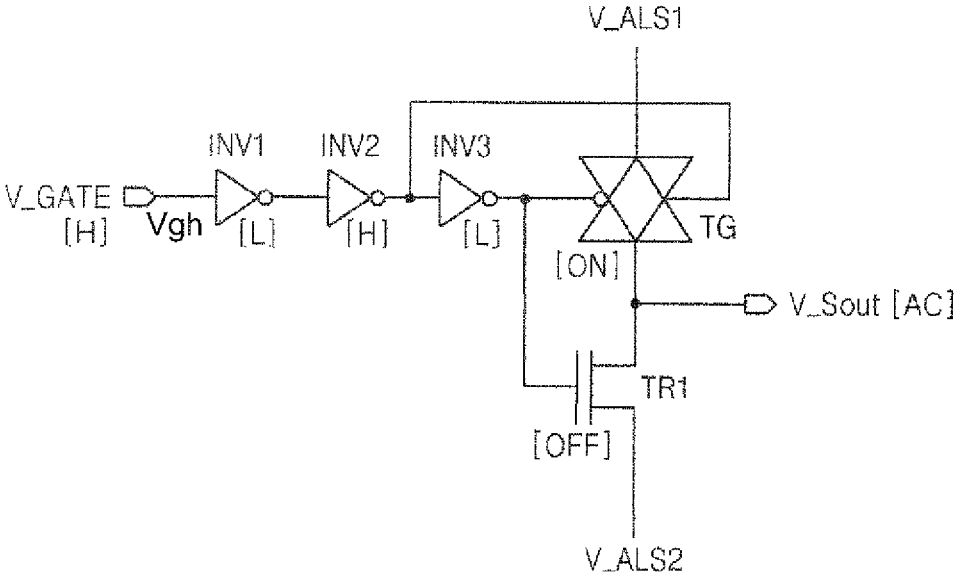

FIGS. 5A and 5B are circuit diagrams illustrating a driving process of the ALS driver of FIG. 2, according to embodiments of the present invention.

Referring to FIG. 5A, an inactive level gate signal V_GATE, applied to a gate line GLi (where i=1 through n), is input to the input terminal IN of the ALS driver from an ith gate line GLi. The inactive level gate signal V_GATE is a first gate signal Vgl that has a low-level [L].

The first inverter INV1 inverts the low-level first gate signal Vgl into a high-level signal and outputs the high-level signal to the second inverter INV2.

The second inverter INV2 inverts the high-level signal received from the first inverter INV1 into a low-level signal and outputs the low-level signal to the third inverter INV3 and the NMOS control terminal of the transmission gate TG.

The third inverter INV3 inverts the low-level signal received from the second inverter INV2 into a high-level signal and outputs the high-level signal to the PMOS control terminal of the transmission gate TG and the control terminal of the transistor TR1.

By the high-level signal received from the third inverter INV3, the transmission gate TG is turned off, and the transistor TR1 is turned on.

Thus, the second ALS voltage V_ALS2 is output as an output signal V_Sout of the ith ALS line ALSLi via the transistor TR1.

Referring to FIG. 5B, an active level gate signal V_GATE is input to the input terminal IN of the ALS driver from an ith gate line GLi (where i=1 through n). The active level gate signal V_GATE is a second gate signal Vgh that has a high level [H].

The first inverter INV1 inverts the high-level second gate signal Vgh into a low-level signal and outputs the low-level signal to the second inverter INV2.

The second inverter INV2 inverts the low-level signal received from the first inverter INV1 into a high-level signal and outputs the high-level signal to the third inverter INV3 and the NMOS control terminal of the transmission gate TG.

The third inverter INV3 inverts the high-level signal received from the second inverter INV2 into a low-level signal and outputs the low-level signal to the PMOS control terminal of the transmission gate TG and the control terminal of the transistor TR1.

By the low-level signal received from the third inverter INV3, the transmission gate TG is turned on, and the transistor TR1 is turned off.

Thus, the first ALS voltage V_ALS1 is output as an output signal V_Sout of the ith ALS line ALSLi via the transmission gate TG.

Figure 6A:
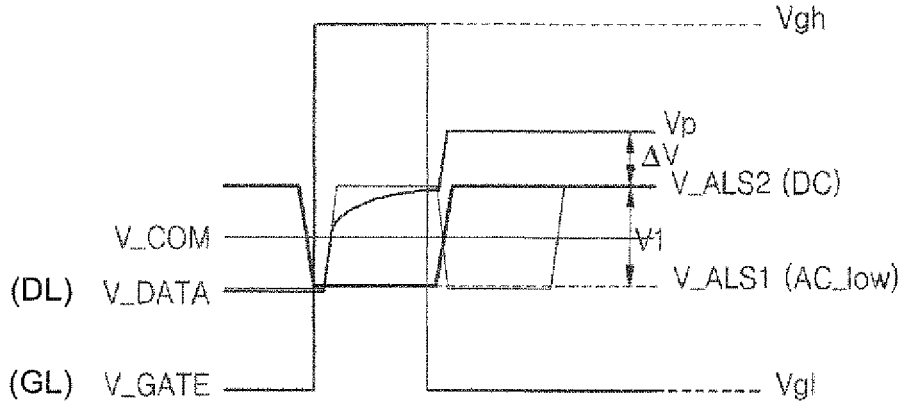
FIGS. 6A and 6B are timing diagrams of driving a LCD device according to an output signal of the ALS driver of FIG. 2.
Figure 6B:
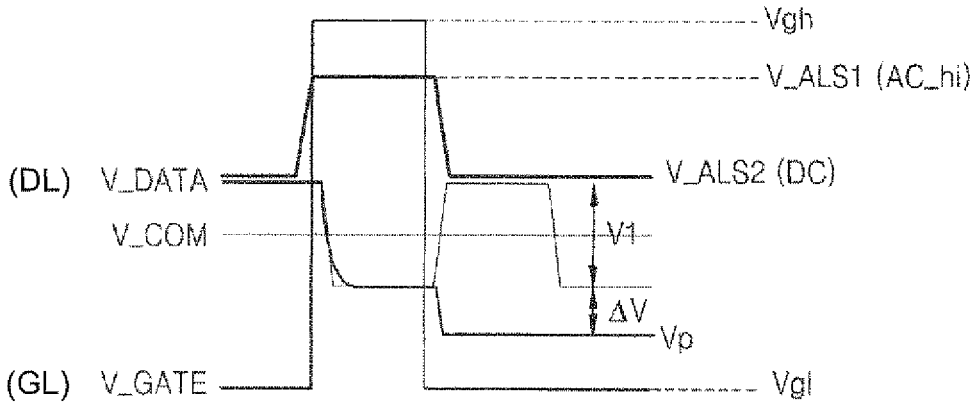

FIGS. 6A and 6B are timing diagrams of driving a LCD device according to an output signal of the ALS driver of FIG. 2.

Referring to FIG. 6A, a gate signal V_GATE is applied to the gate line GL, and a data signal V_DATA that swings with respect to the common voltage V_COM is applied to the data line DL.

When the high-level gate voltage Vgh is applied to the gate line GL, a positive data voltage is applied to the data line DL. Thus, the liquid crystal capacitor Clc is charged by the data voltage to the voltage level V1, so that a pixel voltage Vp that corresponds to the voltage level V1 is applied to the pixel electrode Pe. In this regard, the output signal of the ALS line ALSL is converted from the DC second ALS voltage V_ALS2 to the AC first ALS voltage V_ALS1, and a low-level AC first ALS voltage V_ALS1 is applied to one terminal of the storage capacitor Cst.

When the low-level gate voltage Vgl is applied to the gate line GL, the output signal of the ALS line ALSL is converted from the low-level AC-low first ALS voltage V_ALS1 to the DC second ALS voltage V_ALS2, and the second ALS voltage V_ALS2 is applied to one terminal of the storage capacitor Cst.

Here, the pixel voltage Vp is boosted from the voltage level V1 of the data voltage by ΔV.

Referring to FIG. 6B, a gate signal V_GATE is applied to the gate line GL, and a data signal V_DATA that swings with respect to the common voltage V_COM is applied to the data line DL.

When the high-level gate voltage Vgh is applied to the gate line GL, a negative data voltage is applied to the data line DL. Thus, the liquid crystal capacitor Clc is charged by the data voltage to the voltage level V1, so that a pixel voltage Vp that corresponds to the voltage level V1 is applied to the pixel electrode Pe. In this regard, the output signal of the ALS line ALSL is converted from the DC second ALS voltage V_ALS2 to the AC first ALS voltage V_ALS1, and a high-level AC first ALS voltage V_ALS1 is applied to one terminal of the storage capacitor Cst.

When the low-level gate voltage Vgl is applied to the gate line GL, the output signal of the ALS line ALSL is converted from the high-level AC-hi first ALS voltage V_ALS1 to the DC second ALS voltage V_ALS2, and the second ALS voltage V_ALS2 is applied to one terminal of the storage capacitor Cst.

Here, the pixel voltage Vp is boosted from the voltage level V1 of the data voltage by ΔV.

The ALS driver according to the current embodiment converts the DC ALS voltage into the AC ALS voltage and outputs the AC ALS voltage while the liquid crystal capacitor Clc is charged by the gate-ON voltage applied thereto. The ALS driver converts the AC ALS voltage into the DC ALS voltage and outputs the DC ALS voltage when the gate-OFF voltage is applied thereto. In other words, since the ALS driver uses a single DC voltage, a single DC load is applied thereto, and thus the ALS driver drives at a high speed, and the number of wires is reduced.

Figure 7A:
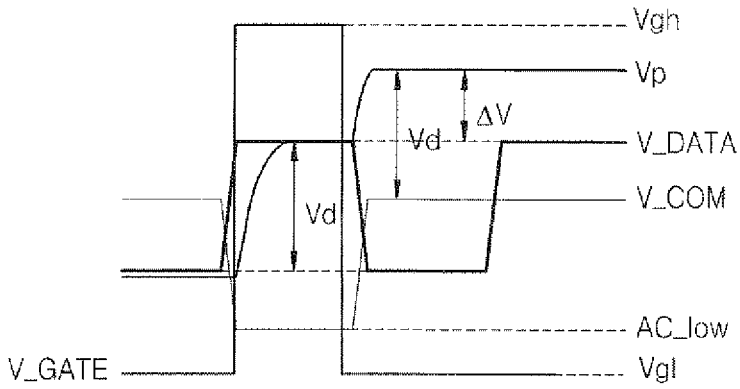
FIGS. 7A and 7B are timing diagrams of driving a LCD device according to an output signal of the ALS driver of FIG. 2 when the ALS driver use a common voltage as a direct current (DC) voltage.
Figure 7B:
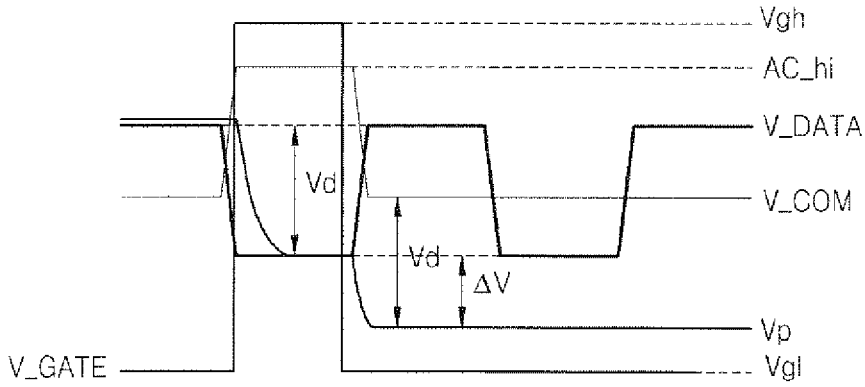

FIGS. 7A and 7B are timing diagrams of driving a LCD device according to an output signal of the ALS driver of FIG. 2 when the ALS driver use a common voltage as a DC voltage. FIGS. 7A and 7B are timing diagrams of FIGS. 6A and 6B when the second ALS voltage V_ALS2 is a DC common voltage V_COM. Here, the data signal V_DATA swings with respect to the common voltage V_COM.

Referring to FIG. 7A, when the high-level gate voltage Vgh is applied to the gate line GL, a positive data voltage is applied to the data line DL. Thus, the liquid crystal capacitor Clc is charged by the data voltage to the voltage level Vd, so that a pixel voltage Vp that corresponds to the voltage level Vd is applied to the pixel electrode Pe. In this regard, the output signal of the ALS line ALSL is converted from the DC common voltage V_COM to the AC first ALS voltage V_ALS1, and a low-level AC-low first ALS voltage V_ALS1 is applied to one terminal of the storage capacitor Cst.

When the low-level gate voltage Vgl is applied to the gate line GL, the output signal of the ALS line ALSL is converted from the low-level AC-low first ALS voltage V_ALS1 to the DC common voltage V_COM, and the common voltage V_COM is applied to one terminal of the storage capacitor Cst.

Here, the pixel voltage Vp is boosted from the voltage level Vd of the data voltage by ΔV, and the voltage level Vd between the common voltage V_COM and the pixel voltage Vp is maintained.

Referring to FIG. 7B, when the high-level gate voltage Vgh is applied to the gate line GL, a negative data voltage is applied to the data line DL. Thus, the liquid crystal capacitor Clc is charged by the data voltage to the voltage level Vd, so that a pixel voltage Vp that corresponds to the voltage level Vd is applied to the pixel electrode Pe. In this regard, the output signal of the ALS line ALSL is converted from the DC common voltage V_COM to the AC first ALS voltage V_ALS1, and a high-level AC-hi first ALS voltage V_ALS1 is applied to one terminal of the storage capacitor Cst.

When the low-level gate voltage Vgl is applied to the gate line GL, the output signal of the ALS line ALSL is converted from the high-level AC-hi first ALS voltage V_ALS1 to the DC common voltage V_COM, and the DC common voltage V_COM is applied to one terminal of the storage capacitor Cst.

Here, the pixel voltage Vp is boosted from the voltage level Vd of the data voltage by ΔV, and the voltage level Vd between the common voltage V_COM and the pixel voltage Vp is maintained.

Since different DC voltages are not required to be generated as the ALS voltage, an AC voltage is applied to the ALS line only by the gate-ON voltage, and a single DC voltage is applied to the ALS line by the gate-OFF voltage, a latch circuit for maintaining a previous DC voltage and a clock generator for driving the latch circuit are not required to provide a different DC voltage. Thus, the drive circuit of the ALS driver is simplified, so that an external black matrix in which the ALS driver is disposed may be slimmed.

According to the present invention, the circuit may be simplified since the ALS driver only includes inverters and a transmission gate. Thus, a LCD device having a slim external black matrix may be provided.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An active level shift (ALS) driver circuit comprising:

a first inverter receiving and inverting a gate signal to output a first inverted signal;

a second inverter receiving and inverting the first inverted signal to output a second inverted signal;

a third inverter receiving and inverting the second inverted signal to output a third inverted signal;

a transmission gate receiving the second inverted signal at a first control terminal and receiving the third inverted signal at a second control terminal, the transmission gate being turned on when the third inverted signal is at a low level and being turned off when the third inverted signal is at a high level, the transmission gate outputting a first power signal to an output terminal of the active level shift (ALS) driver circuit when turned on; and a transistor receiving the third inverted signal, the transistor being turned on when the third inverted signal is at a high level to output a second power signal to the output terminal of the active level shift (ALS) driver circuit.

2. The active level shift (ALS) driver circuit of claim 1, the first power signal being an alternating current (AC) voltage signal, and the second power signal being a direct current (DC) voltage signal.

3. The active level shift (ALS) driver circuit of claim 2, wherein the first power signal swings with respect to the second power signal by a predetermined level.

4. The active level shift (ALS) driver circuit of claim 1, the second power signal being a DC common voltage.

5. The active level shift (ALS) driver circuit of claim 1, the transmission gate comprising a PMOS transistor having the second control terminal, and an NMOS transistor having the first control terminal, a first electrode of the PMOS and NMOS transistors being commonly connected to receive the first power signal, and a second electrode of the PMOS and NMOS transistors being commonly connected to the output terminal of the active level shift (ALS) driver circuit.

6. The active level shift (ALS) driver circuit of claim 1, wherein the first inverter and the second inverter delay the gate signal.

7. A liquid crystal display device comprising:

a liquid crystal panel comprising a plurality of pixel regions formed at intersections between a plurality of data lines and a plurality of gate lines;

a data driver connected to the plurality of data lines, the data driver applying respective data signals to the data lines;

a gate driver connected to the plurality of gate lines, the gate driver sequentially applying respective gate signals to the gate lines; and an active level shift (ALS) driver having a plurality of outputs connected to a plurality of ALS lines disposed to be parallel to corresponding ones of the gate lines, the active level shift (ALS) driver outputting an alternating current (AC) voltage signal when a corresponding gate signal has a first voltage level and outputting a direct current (DC) voltage signal when the corresponding gate signal has a second voltage level.

8. The liquid crystal display device of claim 7, for each ALS line the active level shift (ALS) driver comprises:

a first inverter receiving and inverting the corresponding gate signal to output a first inverted signal;

a second inverter receiving and inverting the first inverted signal to output a second inverted signal;

a third inverter receiving and inverting the second inverted signal to output a third inverted signal;

a transmission gate receiving the second inverted signal at a first control terminal and receiving the third inverted signal at a second control terminal, the transmission gate being turned on when the third inverted signal is at a first level and being turned off when the third inverted signal is at a second level, the transmission gate outputting a first power signal to the ALS line when turned on; and a transistor receiving the third inverted signal, the transistor being turned on when the third inverted signal is at said second level to output a second power signal to the ALS line.

9. The liquid crystal display device of claim 7, wherein the active level shift (ALS) driver outputs the AC voltage signal when the corresponding gate signal is at an active level and outputs the DC voltage signal when the corresponding gate signal is at an inactive level.

10. The liquid crystal display device of claim 7, wherein the DC voltage signal is a DC common voltage.

11. The liquid crystal display device of claim 8, the transmission gate comprising a PMOS transistor having the second control terminal, and an NMOS transistor having the first control terminal, a first electrode of the PMOS and NMOS transistors being commonly connected to receive the first power signal, and a second electrode of the PMOS and NMOS transistors being commonly connected to the output terminal of the active level shift (ALS) driver circuit.

12. The liquid crystal display device of claim 8, wherein the first inverter and the second inverter delay the corresponding gate signal.

13. The liquid crystal display device of claim 7, each pixel region comprising:

a thin film transistor having a gate electrode connected to a corresponding one of the gate lines and a source or drain electrode connected to a corresponding one of the data lines;

a liquid crystal capacitor that charges a data voltage when the thin film transistor is turned on by the corresponding gate signal; and a storage capacitor that receives the AC voltage signal or the DC voltage signal from the ALS line.

14. The liquid crystal display device of claim 7, further comprising a driving voltage generator that generates the AC voltage signal and the DC voltage signal and supplies the AC voltage signal and the DC voltage signal to the active level shift (ALS) driver.

15. A method of driving a liquid crystal display device comprising a plurality of pixel regions formed at intersections between a plurality of data lines and a plurality of gate lines, the method comprising:

applying corresponding gate signals to the gate lines;

turning on a switching device of respective corresponding ones of the pixel regions when the corresponding gate signal has a first predetermined level;

applying a data signal to the pixel region from the data line via the turned on switching device;

providing an alternating current (AC) voltage signal to corresponding ones of the pixel regions via a corresponding one of a plurality of ALS lines disposed to be parallel to the gate lines, when a voltage level of the gate signal has said first predetermined level; and providing a direct current (DC) voltage signal to corresponding ones of the pixel regions via the corresponding one of a plurality of ALS lines, when a voltage level of the gate signal has second predetermined level.

16. The method of claim 15, wherein an active level shift (ALS) driver outputs the AC voltage signal when the gate signal is at an active level and outputs the DC voltage signal when the gate signal is at an inactive level.

17. The method of claim 15, wherein the DC voltage signal is a DC common voltage.

* * * * *